11/25/86 XR 4,624,207 SR

United States Patent [19]

King

[11] Patent Number: 4,624,207

[45] Date of Patent: Nov. 25, 1986

[54] DIVING PLANE

[76] Inventor: John D. King, 184 Vaile St., Tewksbury, Mass. 01730

[21] Appl. No.: 695,964

[22] Filed: Jan. 29, 1985

[51] Int. Cl.[4] ..... B63C 11/46

[52] U.S. Cl. ..... 114/315; 114/245; 114/253

[58] Field of Search ..... 405/186; 114/315, 245, 114/253; 441/65, 72, 73

[56] References Cited

U.S. PATENT DOCUMENTS

| | | | |
|---|---|---|---|
| 2,948,247 | 8/1960 | Rebikoff | 114/315 |
| 2,948,251 | 8/1960 | Replogle | 441/65 X |
| 2,950,923 | 8/1960 | Forney | 441/73 X |
| 3,163,148 | 12/1964 | Duren et al. | 114/245 |
| 3,422,786 | 1/1969 | Brandhorst | 114/253 |

FOREIGN PATENT DOCUMENTS

| | | | |
|---|---|---|---|
| 1036729 | 1/1955 | Fed. Rep. of Germany | 114/315 |
| 1144305 | 3/1969 | United Kingdom | 114/315 |

*Primary Examiner*—Sherman D. Basinger
*Attorney, Agent, or Firm*—Robert T. Dunn

[57] ABSTRACT

An underwater diving plane towed by a boat and ridden by a diver includes a longitudinal diver support member which supports the diver in the prone position, a lateral wing support member with contoured wings attached at the ends thereof and evenly spaced from the center thereof, a pivotal attachment fitting for attaching the front end of the diver support member to the center of the lateral wing support member and one or more control arms that are rigidly attached to the lateral wing support member and that extend therefrom below the diver support member so as to be within easy reach of the diver carried thereon in the prone position, whereby the diver may rotate the lateral wing support member within the pivotal attachment fitting on its lateral axis with respect to the diver support member, thereby controlling the diving angle of the diving plane as it is towed through the water by a tow line attached to the pivotal fitting.

13 Claims, 5 Drawing Figures

DIVING PLANE

BACKGROUND OF THE INVENTION

This invention relates to underwater diving planes for use in towing a diver riding the plane at various depths below the surface of water.

Towed diving planes and related diving apparatus having wings that are controlled by the diver who rides the apparatus have been provided with means whereby the diver can control the apparatus diving angle and so control the depth underwater of the apparatus as it is towed through the water. Heretofore, such towed diving planes available for use by divers searching the bottom of shallow waters up to about 50 feet deep, have been been large and too heavy to be carried in a small boat or manipulated by a single diver.

The few such diving planes that are relatively small and could be manipulated by a single diver, such as the diving plane described in U.S. Pat. No. 2,948,251, issued to Edward A. Replogle on Aug. 9, 1960, and others of similar design, require that the diver manipulate wings that are pivotally attached to the sides of the apparatus using an elaborate mechanism including levers and springs to control the diving angle.

Such prior diving planes usually connect at a point at the center of the plane to a tow line and the tow line attachment is fixed, because in the event of detachment from the tow line, the plane would sink to the bottom of the water and thereafter would be difficult to locate and recover. Hence, the diver using such diving planes cannot disconnect from the tow line if it should become necessary for his own safety or any other reason. If the diver must, for some reason, leave the diving plane quickly, he must disengage himself from the plane and leave such equipment as he is carrying on the plane and while all this is going on he is not able to signal to the tow boat that he is off the plane and by the time the boat operator realizes this, the diver may be a considerable distance away from the towed plane.

The principal object of the present invention is to provide a diving plane of small size and simple structure that can be easily carried in a small boat and manipulated by a single diver.

A further object is to provide a diving plane that has none of the above mentioned limitations of prior diving planes.

Another object is to provide a diving plane that the diver can hold onto while leaving both hands free to control the diving plane and/or operate devices carried on the plane or carried by the diver and that the diver can control with one hand so that his other hand is free to do other things.

It is a further object to provide a diving plane that the diver on board can readily, quickly disconnect from the tow line with one hand and is sufficiently buoyant to float at the water surface so that it can be picked up by the tow boat operator or used as a float by the diver and/or other divers in the vicinity.

SUMMARY OF THE INVENTION

In accordance with the present invention, a relatively lightweight rugged underwater diving plane towed by a boat and ridden by a diver includes a longitudinal diver support member that supports the diver under his armpits and across his chest while he is in the prone position, a lateral wing support member with contoured wings fixedly attached at the ends and evenly spaced from the center thereof, a pivotal attachment fitting for pivotally attaching the front end of the diver support member to the center of the lateral wing support member and one or more control arms that are rigidly attached to the lateral wing support member and that extend therefrom below the diver support member so as to be within easy reach of the diver riding thereon in the prone position, whereby the diver may rotate the lateral wing support member on its lateral axis with respect to the diver support member, thereby controlling the diving angle of the plane as it is towed through the water by a tow line attached to the pivotal attachment fitting.

In a preferred embodiment, the lateral wing support member includes a central unitary structural bar that fixedly attaches at its ends to contoured wings and fittings are provided along the bar between the wings at the ends for pivotally attaching the longitudinal diver support member to the bar and for attaching control levers thereto. Furthermore, a quick release mechanism for the tow line is included on the pivotal fitting and the diving angle control levers and the tow line quick release mechanism are within easy reach of the diver in the prone operating position. By this arrangement, the diver is carried by the diving plane with both hands and arms free and can control the diving angle or release the plane from the tow line with one hand.

Other objects and features of the present invention and a full understanding of the structures thereof may be had by referring to the following description taken in conjunction with the drawings in which:

DESCRIPTION OF EMBODIMENTS OF THE INVENTION

Figure 1:
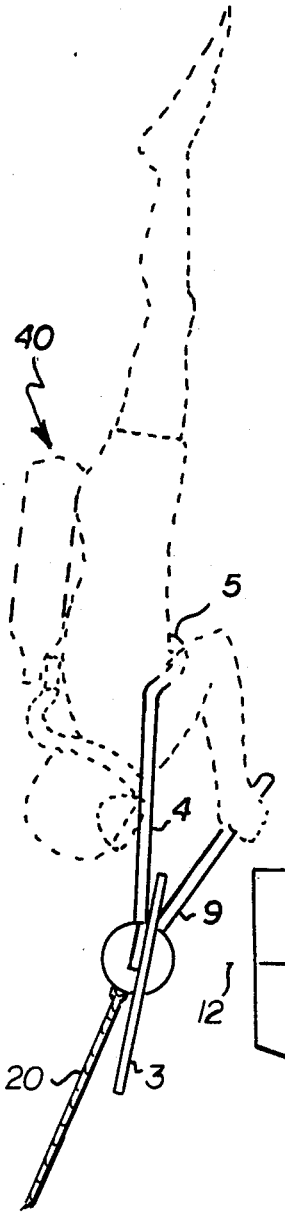
FIG. 1 is a side view of the underwater diving plane incorporating features of the invention in use with the diver shown by broken lines.
Figure 2:
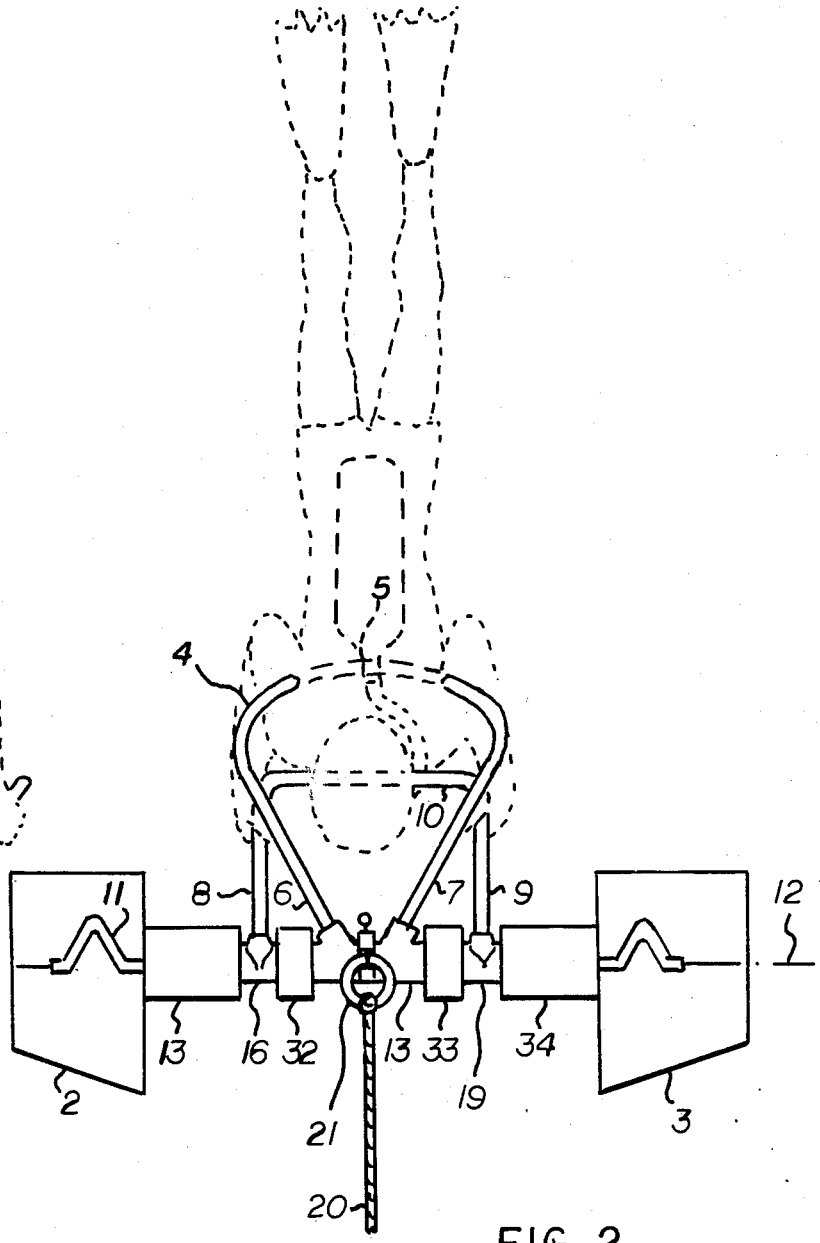
FIG. 2 is a plan view the diving plane in use with the diver shown by broken lines.
Figure 3:
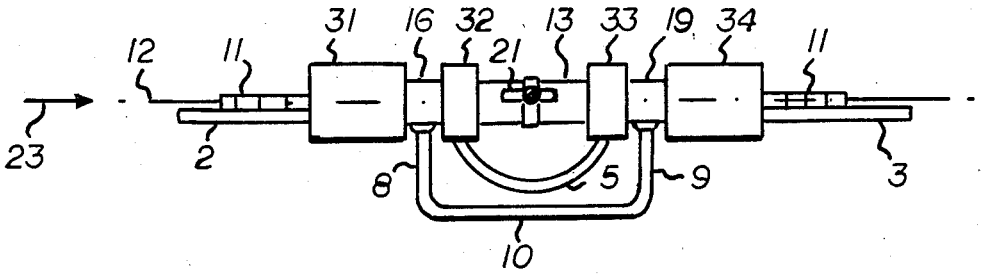
FIG. 3 is a front view of the diving plane taken as shown in FIG. 2, without the diver.

Turning first to FIGS. 1 and 2, there is shown the preferred embodiment of the present invention, inasmuch as it incorporates all features of the invention. As shown, the diving plane includes the lateral wing assembly 1 with diving wings 2 and 3 at the ends thereof and the longitudinal diver support member 4 supporting the diver 40, shown by dashed lines, in the prone position, supported under his armpits and across his chest by a contoured portion 5 of the support member 4. In this prone position, the diver's head, shoulders and arms fit easily within the loop defined by the support member 4 with his arms and hands extending down through the loop. In this position, the diver can readily reach with one or both hands the control levers 8 and 9 that extend from the lateral structure 1.

The control levers 8 and 9 may be connected at their extending ends by a lever bar 10 so that the diver can grasp either lever or the lever bar 10 to rotate the lateral assembly 1 on lateral axis 12 to control the diving angle (angle of attack) of the wings 2 and 3.

The tow line 20, preferably with a ring 21 attached to the end, is fastened to the longitudinal diver support member by a quick release mechanism 22 that is readily within the diver's reach in the position shown so that he can quickly release the tow line with one hand.

Figure 5:
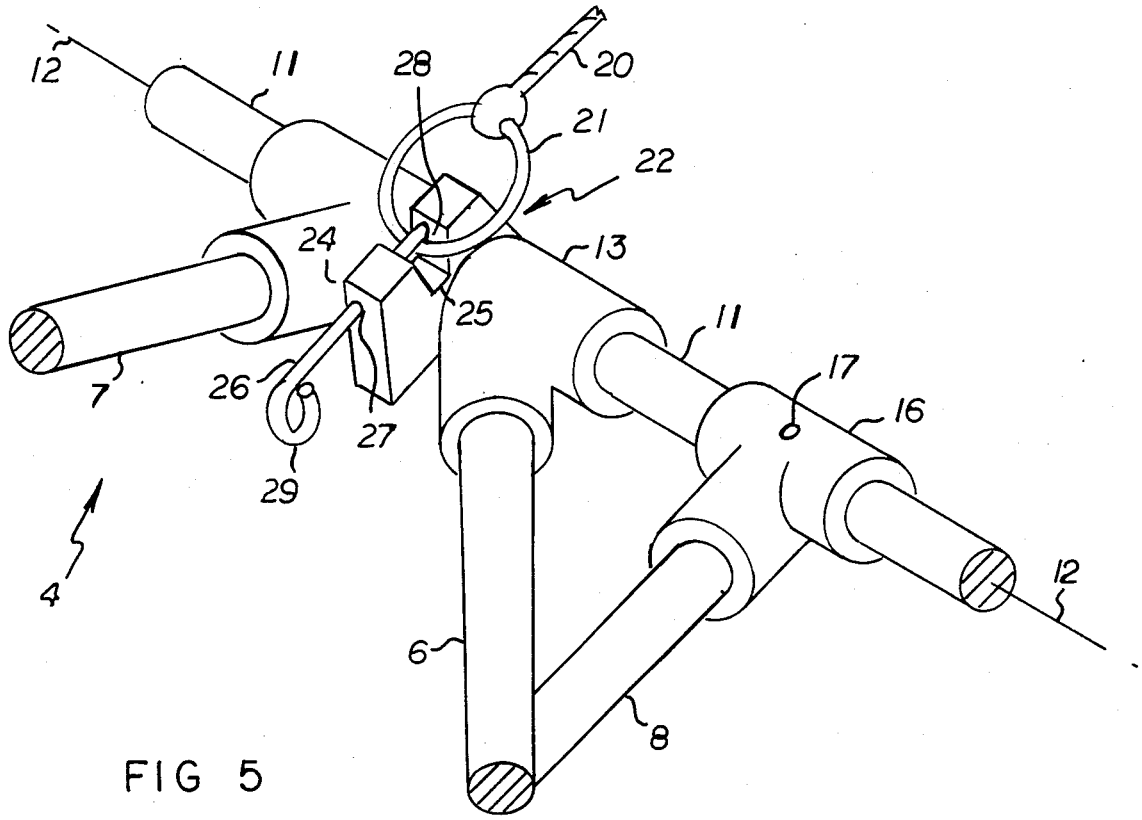
FIG. 5 is an enlarged top-side view of the pivotal fitting on the lateral wing support bar including the fitting attachments to the longitudinal diver support member and the low line quick release and one of the fittings for attaching a diving angle control lever (arm) that the diver operates to control the diving angle.
Figure 4:
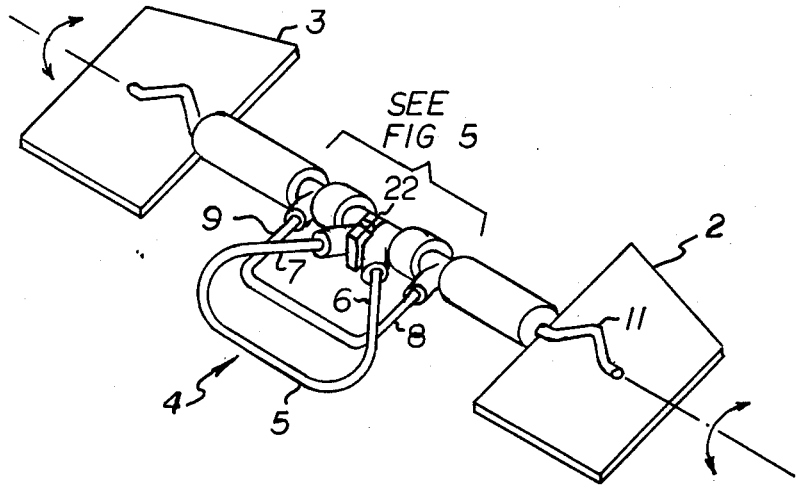
FIG. 4 is a top-side view of the diving plane without the diver.

A top-side view (perspective view) of the diving plane without the diver is shown in FIG. 4 and a portion of the lateral wing assembly 1, indicated in FIG. 4, is shown enlarged in FIG. 5, without buoyant flotation cylinders attached thereto. As shown in FIGS. 4 and 5 the lateral wing assembly 1 includes a coaxial inner structural support bar 11 that defines the assembly axis 12. Bar 11 is preferably made of non-corrosive metal such as aluminum or stainless steel. At the ends of the bar 11 are fixedly attached the wings 2 and 3. For this purpose, the bar may be bent into a V or U shape at the ends as shown in the Figures for rigid attachment to the top side of the wings. The V or U shape of the bar at the ends serves to distribute torque stresses between the bar and wing along the bar axis, rather than only radially.

Between the ends of the bar, the bar is straight and the straight part is loaded with fittings and buoyant floatation cylinders that abut each other along the bar and may be held in axial position by their abutting each other and by the inside edges of the wings.

The central pivotal fitting 13 is preferably a unitary piece with a central bore or opening to fit slideably along the bar and so it can rotate freely with respect to the bar about the bar axis 12. Fitting 13 includes two angled sockets 14 and 15 that extend from the same side of the fitting and accommodate attachment thereto of the ends of the longitudinal diver support member 4, which are inserted into the sockets and secured thereto by, for example, pinning, so that the diver support member is rigidly secured to fitting 13.

Spaced on each side of fitting 13 is a T fitting for each of the control levers 8 and 9. FIG. 5 shows one of these T fittings, 16, for control lever 8. The cross part of the T fitting 16 fits on the bar 11 and is fixedly attached thereto by, for example, a pin 17. The center of T fitting 16 defines a socket 18 to accommodate insertion of the control lever 8 for fixed attachment thereto. In the same way, control lever 9 is attached by T fitting 19 to the bar 11 on the other side of the central pivotal fitting 13. The fittings 13, 16 and 19 may all be made of the same material which is preferably non-corrosive metal or high strength plastic.

These attachments of the control levers 8 and 9 to the lateral bar 11 are such that the levers are below the diver support member 4 and so the rotation of these control levers as viewed along the axis 12 in the direction of arrow 23, is limited by the diver support member 4. Since clockwise rotation in that view increases the diving angle downward (decreases the wing angle of attack), this limit on clockwise rotation of the wings intrinsically limits the downward diving angle of the plane.

At the center of the rotatable fitting 13 is a radial projection 24 in which there is an open notch 25 into which the ring 21 of the tow line 20 slips and is held therein by pin 26. The projection 24 is drilled longitudinally at 27 to accommodate the pin so that when the pin is inserted in the drilled hole 27, the ring is captured in the notch and when the pin is withdrawn from the drilled hole, the ring is free to slide out of the notch and so the tow line is released. For this purpose, the front wall 28 of the notch slopes forward so that the ring slides upward out of the notch from the tow line force thereon. A handle 29 on the pin that may be a simple loop, facilitates inserting it and pulling it out by the diver. In practice it is advisable to tie the pin by a cord or small chain (not shown) to fitting 13 so that it is not lost when pulled out.

The parts of the lateral wing support assembly 1 are assembled before both ends of bar 11 are bent as shown, where they connect to the wings 2 and 3. For example, one end of the bar may be bent to the V or U shape shown and then attached to a wing while the other end is straight. Then the cylindrical floatation bodies 31 to 34 and the fittings 13, 16 and 19 are loaded on bar 11 in the order shown in the Figures. Next, the other end of the bar is bent and attached to the other wing so that the wings are at all times in the same plane. Then, after attaching the longitudinal diver support member 4 to the accommodating sockets 14 and 16 of pivotal fitting 13, the angle of the wings with respect to the diver support member 4 and fitting 13 that results in the maximum downward diving angle of the diving plane while it is being towed at normal speed with a diver on board, is set; and while holding the wings and bar 11 at that set position, the control levers 8 and 9 are rotated clockwise on bar 11 until they hit the underside of support member 4 and, while in that position, the T fittings 16 and 19 are drilled and pinned to bar 11. By this method, the diving plane is rigged so that the maximum downward diving angle is limited.

As mentioned above, the ends of bar 11 where it attaches to the wings 2 and 3 are bent into U or V shapes to better distribute torque stresses between the wing and bar. Furthermore, these attachments are preferably to the top surfaces of the wings so that the bottom surfaces of the wings which experience the greatest water flow pressure are relatively clean and without projections. This attachment may also be positioned fore to aft on the wings so that the water forces on a wing produced as the diving plane is towed through the water, tend to increase the angle of attack of the wings with the water and cause the diving plane to glide upward to the surface of the water, provided the diver takes no control action. This is accomplished by positioning the axis 12 of bar 11 closer to the trailing edge of the wing than the leading edge.

In operation of the diving plane, the diver in the prone position with his head, shoulders and arms within the loop defined by the support member 4, reaches down through 4 and grasps one or both of the levers 8 or 9 or the lever bar 10 that connects them and by pushing the lever away from his body increases the wings angle of attack, causing the plane to glide upward in the water toward the surface. If he pulls the control lever toward his body, he decreases the angle of attack causing the plane to dive deeper into the water. Both of these maneuvers can be performed by the diver readily with one hand, leaving the diver his other hand to operate such devices or equipment as he may carry on his belt or on the diving plane. On the other hand, if the diver releases the control levers, the angle of attack of the wings will tend to increase causing the plane to glide upward to the water surface.

During the course of towing, if the diver wishes to leave the plane, he need only raise his arms and slide off the support member 4 and the plane will glide upward to the surface. If he wished to stop in the water with the diving plane, he need only disconnect it from the tow line by pulling the pin 24 with one hand and if he then lets go of the plane it will rise to the surface due to its buoyancy provided by the floatation cylinders.

The embodiment of the invention described herein is made by way of example and it should be understood that numerous changes in the details of construction may be made without departing from the spirit and scope of the invention as set forth in the appended claims.

I claim:

1. An underwater towed diving plane ridden by a diver that includes wings controlled by the diver for controlling the diving angle of the plane as it is towed through water comprising, (a) a pair of wings, (b) a longitudinal diver support member for supporting the diver in the prone position, (c) a lateral wing support bar to which said wings are rigidly attached at the ends thereof, evenly spaced from the center of said bar, (d) a pivot fitting that pivotally fits said bar at the center thereof and to which the front end of said longitudinal diver support member is rigidly attached and (e) a diving control lever rigidly attached to said bar for rotating said bar about its axis with respect to said longitudinal diver support member to control the diving angle of said diving plane.

2. A diving plane as in claim 1 wherein, (a) said diving control lever attaches rigidly to said bar at points on both sides of said bar center.

3. A diving plane as in claim 2 wherein, (a) said diving control lever attaches to said bar at two points that are equidistant from said bar center and said attachments are connected at their extending ends.

4. A diving plane as in claim 1 wherein, (a) said longitudinal diver support member supports the diver under his armpits and across his chest, so that he can readily manipulate said diving control lever from below said longitudinal support member to control diving angle.

5. A diving plane as in claim 1 wherein, (a) means are provided for attaching a tow line to said pivot fitting and (b) means are provided for quickly releasing said tow line from said tow line attachment, (c) said releasing means being easily within the reach of said diver while supported on said longitudinal diver support member.

6. A diving plane as in claim 5 wherein, (a) said means for attaching a tow line to said pivot fitting includes an open slot of which the opening faces generally upward and (b) said means for quickly releasing said tow line from said slot includes means for closing said slot opening, (c) said releasing means being easily within the reach of said diver while supported on said longitudinal diver support member.

7. A diving plane as in claim 6 wherein, (a) said means for closing said slot opening includes a pin and (b) said pin is so located with respect to said longitudinal diver support member that when properly supporting the diver under his armpits and across his chest with his arms free and extending downward, he can readily manipulate said pin to release said tow line.

8. A diving plane as in claim 1 wherein, (a) relatively highly buoyant bodies are attached to said bar at several positions therealong so as to distribute the buoyant forces thereof evenly on both sides of said bar to said diving plane, (b) whereby said diving plane is sufficiently buoyant to float at the surface of the water.

9. A diving plane as in claim 8 wherein, (a) said buoyant bodies fit on said bar at said several positions therealong which are between said pivot fitting and said diving control lever rigid attachments thereto and between said rigid attachments and said wings attached at the ends of said bar.

10. A diving plane as in claim 9 wherein, (a) said buoyant bodies are cylindrical in shape and have an axial hole therethrough whereby each body fits on said bar coaxial therewith.

11. An underwater towed diving plane ridden by a diver that includes wings controlled by the diver for controlling the diving angle of the plane as it is towed through water comprising, (a) a pair of wings, (b) a longitudinal diver support member for supporting the diver in the prone position, (c) a lateral assembly including a unitary lateral structural support bar coaxial within said lateral assembly to which said wings attach at the ends thereof, evenly spaced from the center of said lateral assembly, (d) a pivot fitting at the center of said bar for attaching the front end of said longitudinal diver support member to said lateral structural bar at the center of said lateral assembly and (e) levers fixedly attached to said lateral structural bar and extending downward beneath said diver support member for rotating said bar about its axis with respect to said longitudinal diver support member to control the diving angle of said diving plane, (f) said pivot fitting fits said bar so as to pivot thereon about said lateral axis and (g) said levers attach to said bar at points on opposite sides of said pivot fitting.

12. A diving plane as in claim 11 wherein, (a) means are provided for attaching a tow line to said pivot fitting and (b) means are provided for quickly releasing said tow line from said tow line attachment, (c) said releasing means being easily within the reach of said diver while supported on said longitudinal diver support member.

13. A diving plane as in claim 11 wherein, (a) relatively highly buoyant bodies are attached to said lateral structural bar at several positions therealong so as to distribute the buoyant forces thereon evenly on both sides of said bar to said diving plane, (b) whereby said diving plane is sufficiently buoyant to float at the surface of the water.

* * * * *